United States Patent [19]

Heckaman et al.

[11] Patent Number: 4,851,793

[45] **Date of Patent: * Jul. 25, 1989**

[54] WAFFLELINE - CONFIGURED TRANSMISSION LINK

[75] Inventors: Douglas E. Heckaman, Indialantic; Roger H. Higman, Palm Bay; Jeffrey A. Frisco, Palm Bay; Edward J. Bajgrowicz, Palm Bay, all of

[73] Assignee: Harris Corporation

[ * ] Notice: The portion of the term of this patent subsequent to Sep. 22, 2004 has been disclaimed.

[21] Appl. No.: 73,096

[22] Filed: Jul. 14, 1987

Related U.S. Application Data

[63] Continuation-in-part of Ser. No. 664,876, Oct. 22, 1984, Pat. No. 4,695,810.

[51] Int. Cl.[4] ..... H01P 5/00; H01P 3/06

[52] U.S. Cl. ..... 333/1; 333/236; 333/243

[58] Field of Search ..... 333/1, 236, 243; 174/117 R, 117 F; 361/410; 340/825.86

[56] References Cited

U.S. PATENT DOCUMENTS 3,076,862 2/1963 Luedicke et al. ..... 333/243 X 3,191,100 6/1965 Sorvillo ..... 361/410

4,695,810 9/1987 Heckaman et al. ..... 333/1

*Primary Examiner*—Paul Gensler

*Attorney, Agent, or Firm*—Antonelli, Terry & Wands

[57] ABSTRACT

A miniaturized transmission link architecture for intercoupling high frequency miniaturized integrated circuit components comprises a thin conductive plate in one surface of which a matrix or grid work of rectilinear grooves or channels are formed, creating "waffle-iron"-like pattern in one surface of the conductive plate. The spacing between channels corresponds to the width of a channel which, in turn, may be sized to substantially match the outer diameter of insulation jacketed wire that is placed in the channels. The depth of a channel or groove is slightly larger than the outer diameter of the wire to accommodate wire crossovers at intersections of the channels. The top surface of the "waffle-plate" is provided with a conductive foil to complete the shielding for the wires. Because the waffle structure has the same periodicity along either of the orthogonal directions of the channels, the characteristic impedance of the transmission link is readily defined by the size of the lands or mesas that are bounded by the channels and the widths of the channels themselves.

19 Claims, 4 Drawing Sheets

WAFFLELINE - CONFIGURED TRANSMISSION LINK

CROSS REFERENCE TO RELATED APPLICATIONS

The present application is a continuation-in-part of copending application Ser. No. 664,876 filed Oct. 22, 1984 for "Waffleline—Configured Microwave Transmission Link" by D. Heckaman et al and assigned to the Assignee of the present application, now U.S. Pat. No. 4,695,810, issued Sept. 22, 1987.

FIELD OF THE INVENTION

The present invention relates generally to an electrical signal transmission medium and, more particularly, to a transmission line matrix structure for interconnecting circuit components, such as monolithic microwave integrated circuit packages.

BACKGROUND OF THE INVENTION

In copending application Ser. No. 535,924 filed Sept. 26, 1983 by D. E. Heckaman et al, entitled "Miniaturized Microwave Transmission Link", and assigned to the assignee of the present application now U.S. Pat. No. 4,641,140, issued Feb. 3, 1987, there is described a pair of recently developed transmission links for intercoupling miniaturized integrated circuit components, in particular microwave circuit components. A first of these links, termed tunnelline, comprises an insulation-jacketed small diameter conductor that lies atop a conductive (ground plane) surface and is covered by a thin metallic foil which forms a "tunnel" through which the center conductor passes; hence, the name tunnelline. The opposite ends of the conductor are connected to the signal ports of components to be intercoupled, while the surrounding conductive material of the "tunnel" provides the shielding/ground plane of the transmission link.

The second type of link, termed channelline, is configured of an insulation-jacketed conductor disposed in a trough or "channel" provided in the surface of a relatively thin metallic plate. Atop the channel is a conductive foil overlay, so that the bottom and side walls of the channel together with the metallic foil provide a conductive shield/ground plane for the center conductor. On the opposite side of the channelled plate, there may be provided a distribution of components, such as microwave antenna elements. Apertures through the plate and intersecting the channels provide through-hole connection points for the channelline center conductor to the antenna elements. The "thinness" of the channelled plate on which the channelline-connected antenna elements are disposed makes the structure particularly suit for conformal applications, such as antenna arrays for high performance aircraft.

SUMMARY OF THE INVENTION

As a further development and improvement in miniaturized transmission links, the present invention provides a scheme for intercoupling circuit components, such as high frequency miniaturized integrated circuit components, that serves as an extremely compact "universal" interconnection architecture and provides a constant transmission line impedance along the link, irrespective of the placement of the IC components within the architecture structure.

For this purpose, the invention comprises a thin conductive plate in one surface of which effectively rectilinear grooves or channels are formed, similar to channelline. Unlike channelline however, in which the grooves are patterned to map a specified interconnection highway among circuit element connection ports, the physical architecture of the channelled plate is such that the grooves are formed as a matrix or gridwork of mutually orthogonal channels, creating a "waffle-iron"-like pattern in one surface of a conductive plate. The spacing between channels corresponds to the width of a channel which, in turn, may be sized to substantially match the outer diameter of insulation jacketed wire that is placed in the channels. The depth of a channel or groove is slightly larger than the outer diameter of the wire to accommodate wire crossovers at intersections of the channels. Like channelline, the top surface of the "waffle-plate" is provided with a conductive foil or plate to complete the shielding for the wires.

In addition to being defined in accordance with wire diameter and dielectric constant of the surrounding insulator, because the waffle structure has the same periodicity along either of the orthogonal directions of the channels, the characteristic impedance of the transmission link is also a function of the size of the lands or mesas that are bounded by the channels and the widths of the channels themselves. For useful operation, this means that the period of the "waffle-line" structure must be less than half the wavelength of signals to be conveyed.

For providing what was previously referened as a universal connection architecture, the entirety of a conductive (e.g. aluminum) plate is initially etched or machined (e.g. through the application of parallel-spaced apart saw cuts) so that the entire surface of one side of the plate has a waffle configuration. Where miniature circuit components are to be provided, selected portions of the waffle structure are further removed to leave pockets for the receiving the components. Because of the reduced size characteristics of the waffle structure, these pockets may be sized to accommodate high density leadless chip carriers whose I/O port connections are substantially aligned with the grooves or channels of the waffle structure, thereby greatly facilitating their interconnection through the channels of the waffle structure.

As pointed out above, because the periodicity of the waffle structure is the same in both orthogonal directions, the characteristic impedance of the transmission link does not change for a change in direction of the connection path provided among the channels of the waffle structure. As a result, circuit component layout design is effectively independent of the connection path map for the components on the plate. Because the waffle structure is in a metallic plate, the components retained in the pockets of the plate are provided with both an electrical ground plane and a substantial heat sink.

A further advantage of the waffle structure of the channels is that the orthogonal periodicity of the channel/mesa structure readily lends itself to computer aided manufacturing techniques, for interconnecting components, such as digital or microwave circuit chips. In this application, the troughs or channels of the waffle-iron configured plate where wires are to be placed are coated with a thin layer of insulation. A wire bonding apparatus may then readily carry out port-to-port connections between chips by laying the wires in the channels as it proceeds from chip port to chip port.

Where uninsulated wires are employed, a thin insulating disk or button or an insulation-providing quick drying liquid material may be machine-placed at wire crossovers. A layer of insulation (dielectric sheet) is laid atop the waffle surface followed by a conductive foil sheet to complete the structure For highest electrical isolation at microwave frequencies this dielectric sheet should have small holes periodically distributed across its surface so as to allow the conductive foil sheet to contact the top surface of each mesa.

DETAILED DESCRIPTION

Figure 1:
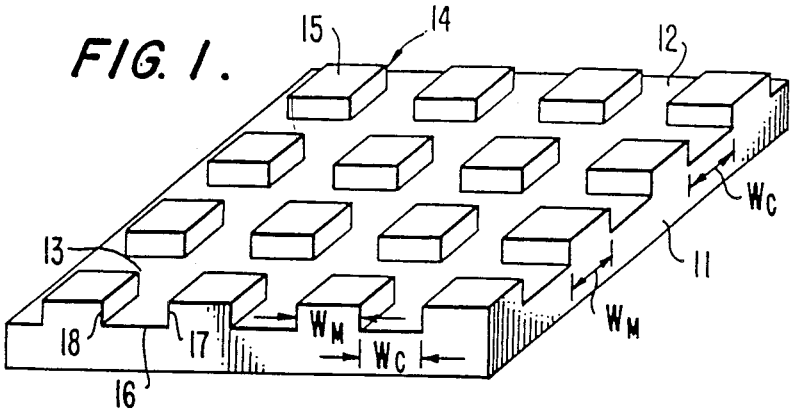
FIG. 1 is a pictorial view of a portion of an embodiment of a waffleline plate.

As pointed out briefly above, the waffleline transmission medium of the present invention comprises a periodic structure of conductive channels and mesas through which insulation jacketed wire is laid. A portion of one embodiment of this "waffle-iron" like or grid-like structure is illustrated in FIG. 1 as plate 11 which comprises a plurality of parallel, spaced-apart channels or grooves 12 that are intersected by a plurality of parallel, spaced-apart channels 13, extending in a direction transverse to channels 12, thereby defining a matrix of substantially rectangular or box-shaped mesas 14 of plate material therebetween. Each of mesas 14 has a top surface 15, while each of the channels 12 and 13 shares a contiguous bottom surface 16. Also, each of channels 12 and 13 has the same cross section. For a typical channel, such as channel 12, the channel is defined by a pair of spaced apart side walls 17 and 18 of opposite mesas 14 and bottom surface 16. The separation between side walls 17 and 18 or channel width $W_c$ is the same for each channel and is sized to define, together with the width $W_m$ of a mesa, the period of the transmission line and thereby a prescribed fraction of the wavelength of the upper cutoff frequency of the spectrum of signals the transmission link structure is intended to accommodate. For signal frequencies of up to 18 GHz and beyond a channel width $W_c$ may be on the order of 0.020 inches, while the mesa width or thicknesses $W_m$ may be on the order of 0.030 inches. In order to permit wire crossovers, the depth D of each channel must be approximately the same or greater than the outer diameter of the wire used. Where the dielectric jacket surrounding the center conductor is relatively "soft" or "deformable", slightly oversized wire can be used to advantage. In this case, as the wire is inserted into a channel, the dielectric jacket deforms slightly to enable the wire to be held in place by the side walls of the channel mesas. Using a Teflon (trademark of Dupont)-jacketed wire having an inner conductor of 0.008" diameter and 0.019" diameter jacket, and with the depth D of each channel on the order of 0.025", the resulting characteristic impedance is 50 Ohms.

Figure 2:
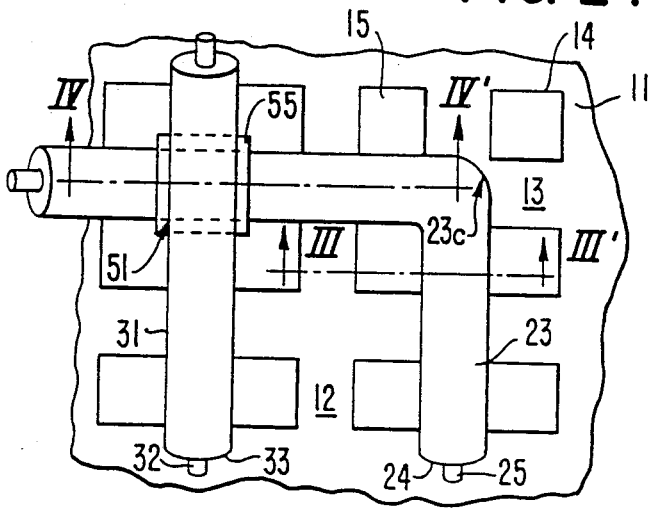
FIG. 2 is a top view of a portion of the embodiment of a waffleline plate shown in FIG. 1 and having signal lines disposed in channels of the plate.
Figure 3:
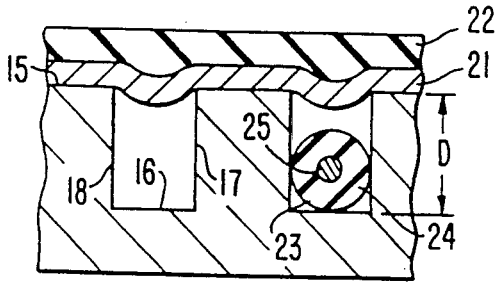
FIGS. 3 and 4 are partial sectional views of the waffleline structure of FIG. 2 taken along lines III—III' and IV—IV' of FIG. 2, respectively.

FIG. 2 shows a top view of a portion of a waffleline plate structure 11, in the channels of which jacketed conductors 23 and 31 have been placed. FIG. 3 shows, in partial section, a portion of the waffleline structure taken along lines III—III' in FIG. 2, while FIG. 4 shows a partial section taken along lines IV—IV' of FIG. 2.

As shown in these Figures, wires 23 and 31 traverse respective paths in the bottom of respective channels of the waffleline. Wire 23 extends partially in a left-to-right direction as viewed in FIG. 2 and is curved or bent at right angle corner 23*c* to extend in an up and down direction therefrom as viewed in FIG. 2. Partially in parallel with signal line 23 is a signal line 31 which extends in an up and down direction as viewed in FIG. 2. Signal line 31 crosses over signal line 23 at crossover point 51.

As shown in FIG. 3, each signal line, such as signal line 23, consists of a center conductor 25 surrounded by an insulating jacket 24. For the frequency range mentioned previously, using a number thirty-two Teflon-coated wire, the inner conductor diameter of conductor 25 may be on the order to 0.008" while the outer dielectric diameter of jacket 24 may be on the order of 0.019".

Figure 4:
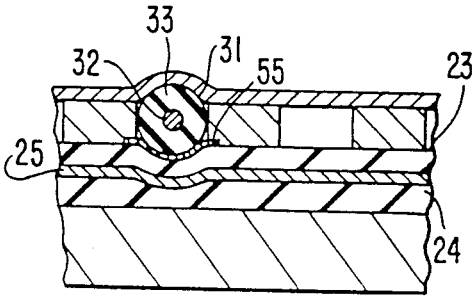

In order to permit point crossovers, such as at crossover 51, shown in FIG. 2, the channel depth must be greater than the outer diameter of the signal line employed, although some bulging of the overlying foil layer 21, as viewed in FIG. 4, is acceptable. For a desired characteristic impedance $Z_o$ of 50 ohms, to provide point crossovers and, if necessary, parallel lines in the same channel (not shown), a channel depth D of 0.025" is preferable, as pointed out previously. Where parallel lines are provided in the same channel it will be realized that the characteristic impedance will change from the preestablished nominal value (e.g. 50 ohms). Accordingly, such a parallel configuration of the lines, if necessary, should be limited to non-critical D.C. or low frequency signals.

As shown in FIG. 3 once the signal lines have been placed in the channel portions of the waffleline grid structure, a conductive foil layer 21 is placed atop the wafflelike structure and then a resilient pliable pad, such as an elastomer pad 22, followed by a housing closing plate (not shown) is placed atop the foil to compress the foil down onto the conductive surface of the waffleline mesas 14 to provide complete shielding surrounding the signal line conductors.

To establish the characteristic impedance along the transmission link, the impedances of the two different cross sections of the structure (through the mesas such as along the cross section lines III—III', and through the air spaces where the channels lies, such as along section lines IV—IV') are determined and averaged to obtain an overall characteristic impedance. For the parametric values described here, the physical period of the structure is 0.05", i.e. the 0.02" channel width $w_c$ plus the 0.03" mesa thickness $W_m$.

For a typical waffleline transmission link, such as signal line 23 disposed in one of the waffleline channels, as illustrated in the cross section of FIG. 3, the transmission line structure will support a quasi-TEM mode of propagation in a near dispersionless medium. Of course, it should be realized that the 50 ohm characteristic impedance and the dimensions of the periodic structure referenced-above are not to be considered limitative of the invention. Corresponding geometries to provide a characteristic impedances of 25–100 ohms may be appropriately chosen in accordance with the principles of the invention. In addition, the waffleline structure is not limited to use with microwave signalling components. As a periodic transmission line, it has use with a wide variety of signalling applications, such as digital signalling (e.g. data processing components).

As described above, with reference to the exemplary configurations of the signal lines illustrated in FIGS. 2–4, in accordance with the present invention signal line crossovers, such as at crossover point 51 for lines 23 and 31, are permitted. An important feature of the waffleline configuration of the present invention is that shielding between the crossing-over signal lines is unnecessary. For frequencies in the neighborhood of 18 GHz, isolation between the wires has been found to be better than 30 dB. Further isolation, if desired, can be provided by providing thin metal foil shields at the crossover points, as identified by reference numeral 55 in FIG. 2. In addition, for signal lines in adjacent channels, there is substantial decoupling. Measurements on the signal lines in adjacent channels reveal that isolation between the wires to be greater than 50 dB up through 18 GHz.

Figure 5:
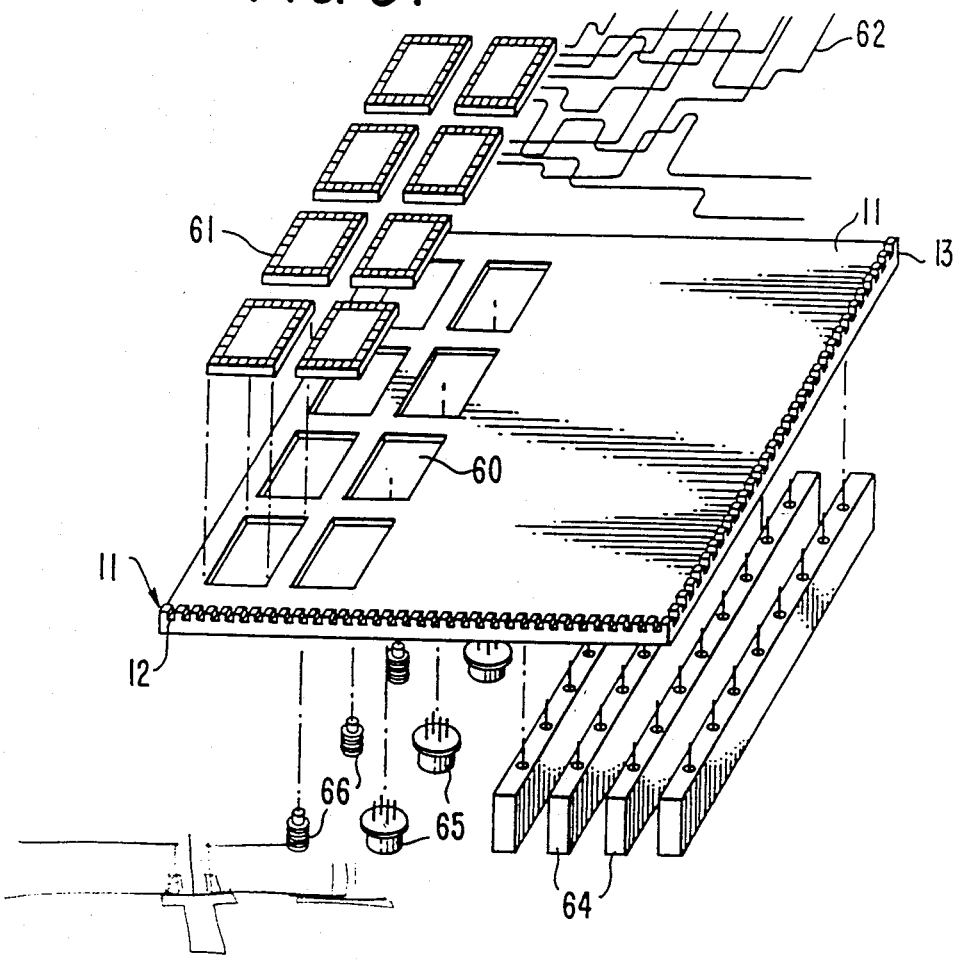
FIG. 5 is an exploded view of a waffleline assembly containing MMIC components.

FIG. 5 shows an exploded view of an overall waffleline assembly wherein a plurality of pockets 60 are provided by the selective removal of portions of the waffleline grid pattern within the waffleline plate 11. For purposes of simplifying the drawing, the mesas/channel structure of only two adjacent intersecting edges of plate 11 have been depicted. The pockets 60 are obtained by selectively removing portions of the metallic plate, including the mesas, to provide the above referenced pockets in which circuit components, such as microchip carriers 61 are inserted Advantageously, because of the conductive material of which plate 11 is made, plate 11 provides a heat sink for the chip carriers 61. The signal wires that are laid out in the grid pattern of the waffleline are shown by plural signal lines 62. These lines are laid out in accordance with a prescribed map connection pattern to connect the chip carriers to other miniaturized microwave integrated circuit elements within the assembly. In some instances, it may be desired to fabricate the assembly such that module packaging assemblies are disposed on the opposite side of the waffleline plate 11. These are represented, for example, by hybrid modules 64, T.0. cans 65 and SMA connectors 66.

Figure 6:
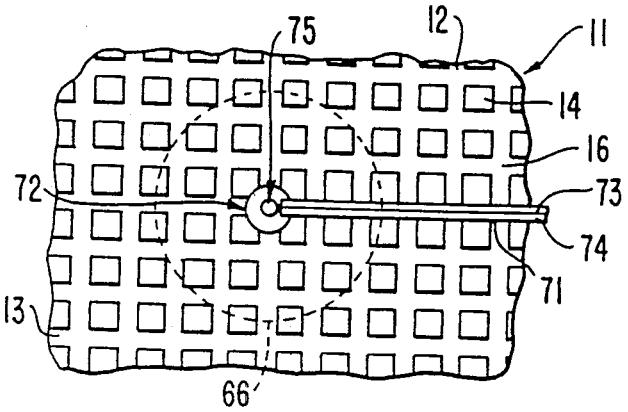
FIG. 6 is a top view of a waffleline plate showing an aperture feed through connection.

FIG. 6 shows the manner in which a feed through connection from the bottom surface of the channels of the waffleline is provided to circuit modules on the opposite side of the waffleline body. As an example, consider the connection of one of the SMA connectors 66 shown in FIG. 5 to a signal line disposed in one of the channels of the waffleline plate. The signal conductor is shown in FIG. 6 as wire 71, having an inner conductor 73 surrounded by an outer dielectric (e.g. Teflon) jacket 74. A circular aperture 72 is provided through the waffleline plate 11, in a direction orthogonal to the surface 16 of the channels. For the dimensions referenced above, aperture 72 may have a diameter of approximately 0.05". The center pin 75 of the SMA connector 66 extends through aperture 72 and is connected to the center conductor 73 of signal line 71. This pin connection from the SMA connector to the center conductor of the signal line 71 provides a right angle launch into the signal line, similar to that of a 90° launch into strip line, thus providing wide band width application of the waffleline structure.

Figure 7:
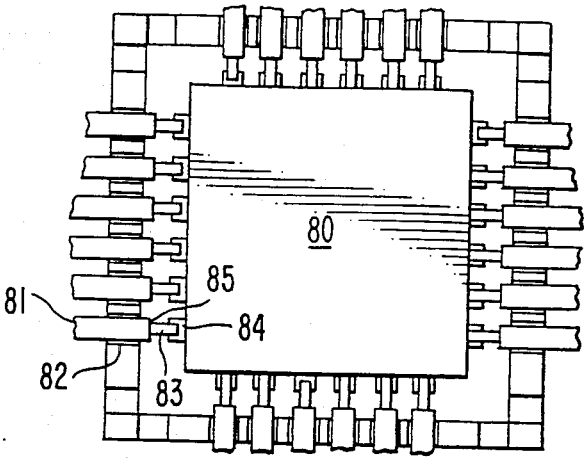
FIG. 7 is a top view of a waffleline assembly for a microwave chip carrier.

FIG. 7 shows the manner in which a plurality of signal lines which lie in channels of the waffleline structure are connected to bonding areas on a leadless chip carrier for providing the interconnection miniaturized circuit components, such as MMIC chips. The carrier itself 80 has a plurality of bonding pads 84 around its periphery. Each of its signals lines, such as signal line 81 which has an outer jacket 82 and a center conductor 83, is disposed such as the region of the wire where the jacket is removed, namely the front edge 85, directly abuts against the edge of the carrier so that center conductor 83 lies atop the bonding area 84. The wire-to-bonding area connection may be achieved using conventional weld, solder or conductive epoxy bonding Then, a housing cover portion, which may include a protective elastomer ring at the bonding areas, is placed over the chip carrier to complete the structure.

As mentioned above, manufacture of the waffleline grid structure of plate 11, to produce a plurality of orthogonally intersecting channels 12 and 13 separated by mesas 14 can be achieved by machining or etching techniques. For example, a multi-blade circular saw mounted on a single arbor in an automatic feed milling machine may be employed to cut the channels 12 and 13 through sequential cuts as the plate is cut, and then rotated 90° and followed by a recut. Investment casting which requires very little machining clean-up may also be employed. In this scheme, all design features, including the shape, configuration, and component mounting pockets as well as the waffle iron grid structure can be formed at one time. Injection molding may also be employed. For each process, aluminum may be employed as the material of the waffleline group plate.

As pointed out previously, one of the significant advantages of the grid structure of the waffleline interconnection scheme is the fact that the waffleline plate provides a large-surfaced heat dissipation mechanism. The degree of heat dissipation can be increased imply by increasing the thickness of the plate itself. In this regard, channels can be provided for supplying cooling fluid to run through the waffleline plate beneath the bottom surface 16 of the channels.

A further advantage of the structure of the present invention is the fact that the combination of the covering metal foil and elastomer cover which presses the foil against the top surface of the mesas provides substantial resistance to vibration, contributing to high reliability package that is especially attractive in airborne environments.

Figure 8:
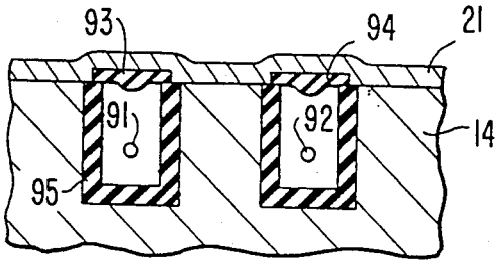
FIG. 8 is a partial sectional view of a waffleline plate structure provided with a dielectric coating on the channel/mesa grid structure.

In addition to the use of microwave quality jacketed-conductor wire, it is also possible to provide slower speed control wire bundles and DC wires laid in a common channel of the waffleline grid structure. It is also possible to use automatic wire bonding techniques to provide direct connections between chip terminal points. In these applications, the metallized waffleline grid structure is provided with a thin layer of dielectric insulation material, such as insulator layer 95, illustrated in the partial cross sectional view of a further embodiment of the invention illustrated in FIGS. 8 and 9, FIG. 8 being a partial sectional view taken along line VIII—VIII' of the top view of a waffleline grid structure shown in FIG. 9. As seen in FIGS. 8 an d9, an insulator layer 95 is coated on the side walls 17 and 18 of the mesas and the bottom wall or surface 16 of the channels. The upper surfaces of the mesa remain exposed to receive an overlying aluminum foil layer.

Figure 9:
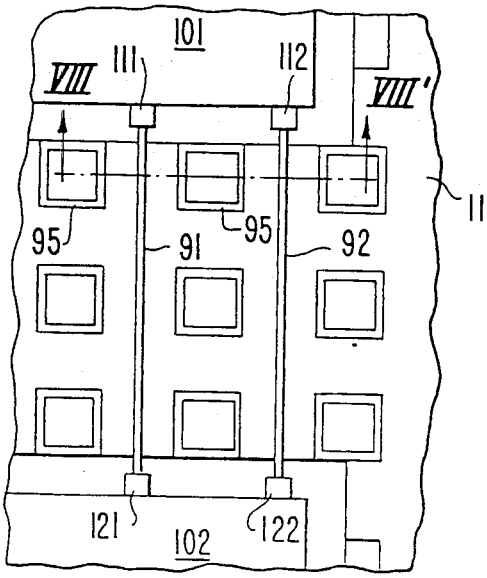
FIG. 9 is a top a waffleline plate structure a partial sectional portion of which is shown in FIG. 8.

As shown in FIG. 9, a pair of chips 101–102 are provided in pockets of the waffleline grid structure 11. Terminal connection land portions 111 and 112 of chip 101 are to be connected to land portion 121 and land portion 122, respectively, of chip 102. Using present day automated wire bonding techniques for lead connections for integrated circuit chips, the wire bonding apparatus can be readily programmed to make the connections directly point-to-point as shown in FIG. 9, or through whatever appropriate interconnection path among the channels of the grid network may be necessary, taking into account, of course, the fact that the wires must reside in channels where there is no possibility of contact.

To prevent possible shorting of the wires 91 and 92 to the metal foil 21 that lies atop the mesas 14, insulator layers such as 93 and 94, as shown in FIG. 8, may be provided so that insulator layers 93 and 94, together with the insulator layer 95 of the waffle-like structure, provide the same insulation protection and characteristic impedance control as the dielectric jackets of the signal conductor wires in the embodiment described above. In addition, as mentioned previously, where bare wires such as wires 91 and 92 crossover one another a thin insulating disk or button or an insulation—providing quick drying liquid material may be machine-placed at the wire crossovers. The combination of the conductive ground plane of the mesas and foil completes the shielding for the transmission link.

In the waffleline transmission link structure described above, the waffle-iron-line or grid-like pattern of mesas has been described as being provided on one side of the waffleline plate. It is also possible to duplicate this structure on the opposite side of the plate to create a two-sided waffleline structure as will be described below with reference to FIGS. 10–13.

Figure 10:
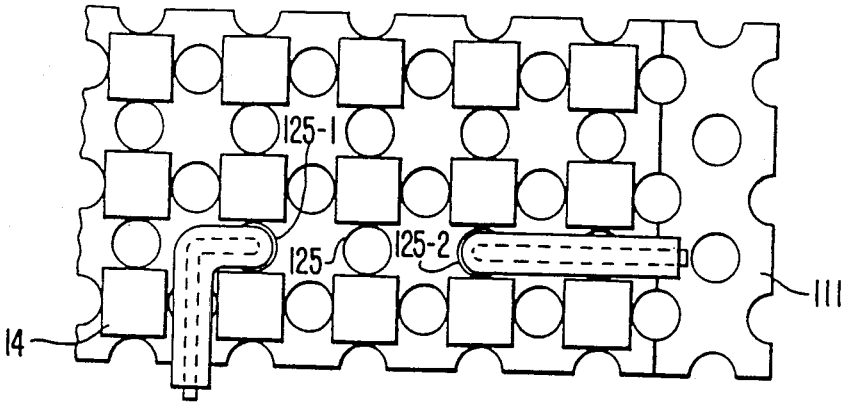
FIGS. 10 and 11 are respective top and side views of a portion of a two-sided waffleline plate with feed through holes through which a signal lines passes.
Figure 11:
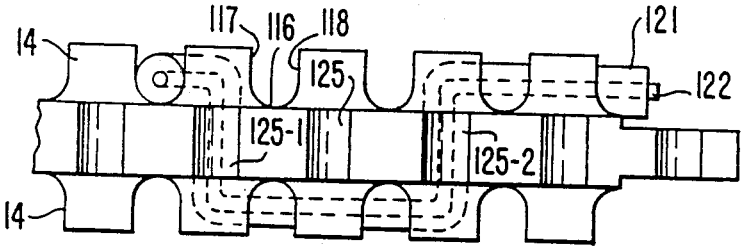

More particularly, as shown in FIGS. 10 and 11, which are respective top and side views of a portion of a two-sided waffleline plate, separate grid works of mesas 14 extend on the top and bottom surfaces of a plate 111. Unlike the configuration of the channels defined by the size of the mesas in the embodiment shown in FIG. 1, in the embodiment shown in FIGS. 10 and 11, the side walls of the mesas at the bottom are curved so as to define channels having a semi-circular cross section. This is best illustrated in FIG. 11 which shows a pair of opposing side walls 117 and 118 of opposing mesas being curved at the bottoms thereof to extend to what is, in effect, a thin line floor portion 116 which constitutes the bottom surface of the top side of the plate 111. Each of these bottom line floor portions 116 is contiguous with those of the other channels just as the floor portions 16 in the embodiment of FIG. 1 are contiguous with one another. The semi-circular cross-section of the bottom of each channel is sized to accommodate the outer diameter of signal wires such as wire 121 which passes through a channel, as shown.

In addition to having a two-sided waffleline structure, plate 111 is also provided with a matrix or gridwork of feed through apertures 125 the diameters of which are sized to correspond to the separation between the side walls 117 and 118 of the mesas, as shown. This matrix of feed through apertures 125 thus provides a transmission line feed through path from one side of the plate to the other side of the plate. In the illustration shown in FIGS. 10 and 11, signal line 121 passes through the top side of the plate at aperture 125-1, extends through a channel along the bottom of the plate and then passes through another aperture 125-2 to once again lie in a channel on the top side of the plate. Such two-sided channel configuration and feed-through geometry increases the number of paths that are available for the signal lines to travel. As is the case with the waffleline structure shown in FIGS. 1–4, the tops of the mesas 14 are provided with a conductive foil to complete the shielding of the signal lines.

Figure 12:
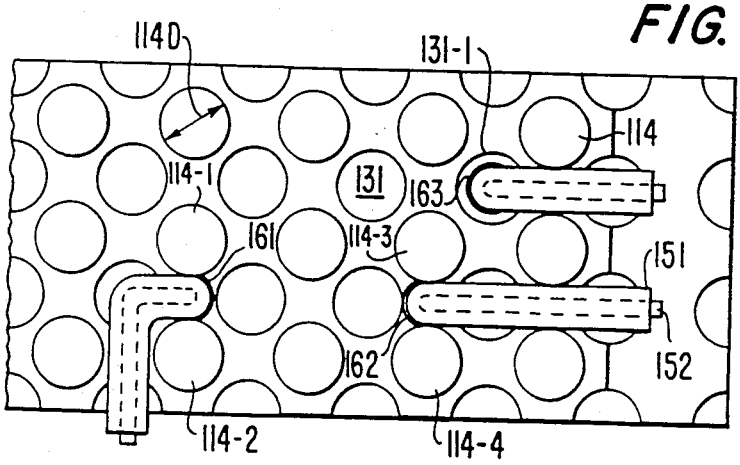
FIGS. 12 and 13 are respective top and side views of a portion of a two sided waffleline plate with rounded or cylindrical mesas and bottom floor depressions.
Figure 13:
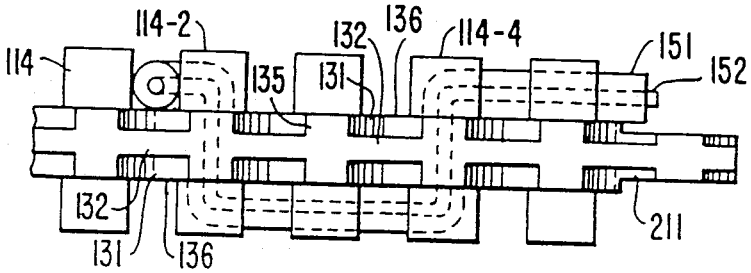

A further embodiment of a two-sided waffleline structure in which the characteristic impedance is significantly increased is shown in FIGS. 12 and 13. FIG. 12 is a top view of a two-sided waffleline plate structure 211 in which each of mesas 114 of which the waffleline structure is configured has a circular cross-section or a cylindrical configuration having a cross-sectional diameter 114D, as shown. As each mesa comprises a solid right-circular cylinder, it extends to a flat floor portion 136 to define the mutually orthogonal channels distributed among the cylindrical mesas 114.

For enhancing the characteristic impedance, a matrix or gridwork of cylindrical cuts outs 131 is provided in the floor surface 136 of each side of the plate 211 and are distributed among the mesas so as to lie between diagonally opposed mesas, as shown in the top view of FIG. 12. The cylindrical side wall 135 of each cylindrical depression or cut out extends from the floor 136 of the plate 211 to a bottom land portion 132 a prescribed depth in the plate itself. The depth is chosen from a standpoint of characteristic impedance desired. The effect of the circular depressions is to decrease the effective dielectric constant surrounding the conductor at the intersections of the mutually orthogonal channels defined by the matrix of mesas.

Like the embodiment shown in FIGS. 10 and 11, feed through apertures such as apertures 161 and 162, shown in the top view of FIG. 12, through which a signal line, such as signal line 151, may extend, are provided. The apertures may be provided between adjacent mesas such as between mesas 114-1 and 114-2 or between mesas 114-3 and 114-4, as shown in the top view of FIG. 12, or they may be provided in the cylindrical depressions or cut outs 131, such as aperture 163 provided in cut out 131-1 as shown in the top view of FIG. 12. Again, as in the embodiment shown in FIGS. 10 and 11, the two-sided waffleline structure increases the path availability for the signal lines. Moreover, by providing the bottom floor cut outs or depressions 131, the characteristic impedance along the signal line channel is increased.

As will be appreciated from the foregoing description of the waffleline grid structure of the present invention, there is provided an improved interconnection scheme for both digital and microwave monolithic circuits. The waffleline grid structure packaging technique is capable of providing excellent RF performance and high packaging density for monolithic circuits disposed in both pockets on the waffleline structure and the opposite sides of the waffleline plate. In addition to the packaging density and low loss RF connections, the present invention offers good isolation even where there are signal path crossovers at high microwave frequencies (up to and beyond 18 GHz high speed transmission (on the order to 0.8 times the speed of light) and a substantial heat sink for thermal dissipation. This compares quite favorably with presently employed stripline and microstrip printed circuit boards, twisted wire pairs and coaxial lines, which are not capable of providing, in total, all of the above features of the invention.

While we have shown and described several embodiments in accordance with the present invention, it is to be understood that the same is not limited thereto but is susceptible to numerous changes and modifications as known to a person skilled in the art, and we therefore do not wish to be limited to the details shown and described herein but intend to cover all such changes and modifications as are obvious to one of ordinary skill in the art.

What is claimed:

1. A transmission line structure for effecting signal transmission between spaced apart circuit components comprising a plate member at least one side of which is formed with a first plurality of regularly-spaced, parallel channels extending in a first direction, and a second plurality of regularly-spaced, parallel channels extending in a second direction transverse to said first direction, so as to form, with said first plurality of channels, a waffer-iron-like arrangement of mesa portion each of which extends from a commonly-shared floor for each of said channels to a prescribed height above said floor, the commonly-shared floor, side walls of said channels defined by side walls of said mesa portions, and top land portions of said mesas comprising conductive material and at least one circuit component receiving portion for accommodating at least one circuit component, so that said waffle-iron-like arrangement of mesa portions forms, with said conductors for connection to said at least one circuit component and disposed in said channels of said first and second pluralities of regularly-spaced parallel channels, a transmission line structure that is periodic in both of said first and second directions and provides a constant transmission line impedance irrespective of a change in channel direction of the disposition of a conductor along channels of either of said first and second pluralities of channels, said at least one circuit component receiving portion comprising a pocket recessed in said commonly-shared floor so that channels of said first and second pluralities of channels are interrupted thereby.

2. A transmission line structure according to claim 1, wherein the side walls and commonly-shared floor of said channel portions are provided with a layer of insulator material thereon.

3. A transmission line structure according to claim 1, wherein said plate member is provided with a plurality of circuit component receiving portions containing circuit components therein, said circuit components having electrical connection portions disposed in alignment with channels of said plate member, and further comprising a plurality of dielectric-surrounded conductors disposed in selected ones of said channels and providing signal path connections to said electrical connection portions of said circuit components.

4. A transmission line structure according to claim 3, further including a layer of conductive material disposed over said channels and being electrically connected to the top land portions of said mesas.

5. A transmission line structure according to claim 4, wherein said layer of conductive material comprises a layer of conductive foil covering said channels and being contiguous with the top land portions of said mesas, and further comprising a layer of flexible material disposed atop said conductive foil layer urging said foil into intimate contact with the top land portions of said mesas so as to be contiguous therewith.

6. A transmission line structure according to claim 3, wherein the height of each of said mesa portions exceeds the outer diameter of said dielectric-surrounded conductors, and wherein said plurality of conductors is arranged in said channels so that, at at least one of the intersections of said first and second pluralities of channels, conductors disposed therein cross over one another, and further comprising a thin portion of conductive material disposed between selected portions of dielectric-surrounded conductors where said conductors overlie one another in a commonly-shared portion of one or more channels.

7. A transmission line structure according to claim 1, wherein said plate member further includes conductive-walled apertures extending therethrough to be intersected by channels of said first and second pluralities of channels, through which apertures electrical connections between circuit components mounted on the side of said plate member opposite the side wherein said channels are provided may pass for connection to said signal conductors.

8. A transmission line structure according to claim 1, wherein said plate member has first and second sides each of which is formed with said first and second pluralities of said regularly-spaced, parallel channels.

9. A transmission line structure according to claim 8, wherein said plate member further includes conductive-walled apertures extending therethrough to be intersected by channels of said first and second pluralities of channels on said first and second sides of said plate member.

10. A structure for supporting and providing signal transmission links among a plurality of spaced apart circuit components comprising a conductive plate member having formed in at least a first surface thereof a first plurality of regularly-spaced, parallel channels extending in a first direction, and a second plurality of regularly-spaced, parallel channels extending in a second direction transverse to said first direction, so as to form, with said first plurality of channels, a waffle-iron-like arrangement of mesa portions each of which extends from a commonly shared floor for each of said channels to a top land portion having a prescribed height above said commonly shared floor, and at least one circuit component receiving portion comprising a pocket recessed in said commonly shared floor so that channels of first and second pluralities of channels are interrupted thereby and in which is provided at least one respective circuit component, so that said waffle-iron-like arrangement of mesa portions forms with signal conductors for connection to said at least one circuit component and disposed in said channels of said first and second pluralities of regularly-spaced parallel channels, a transmission line structure that is periodic in both of said first and second directions and provides a constant transmission line impedance irrespective of a change in channel direction of the disposition of a conductor along channels of either of said first and second pluralities of channels.

11. A transmission line structure for effecting signal transmission between spaced apart circuit components comprising a plate member at least one side of which is formed with a first plurality of regularly-spaced, parallel channels extending in a first direction, and a second plurality of regularly-spaced, parallel channels extending in a second direction transverse to said first direction, so as to form, with said first plurality of channels, a waffle-iron-like arrangement of mesa portions each of which extends from a commonly-shared floor for each of said channels to a prescribed height above said floor, the commonly-shared floor, side walls of said channels defined by side walls of said mesa portions, and top land portions of said mesas comprising conductive material, and at least one circuit component receiving portion for accommodating at least one circuit component, so that said waffle-iron-like arrangement of mesa portions forms, with signal conductors for connection to said at least one circuit component and disposed in said channels of said first and second pluralities of regularly-spaced parallel channels, a transmission line structure that is periodic in both of said first and second directions and provides a constant transmission line impedance irrespective of a change in channel direction of the disposition of a conductor along channels of either of said first and second pluralities of channels, said at least one circuit component receiving portion being coupled with an aperture, walls of which are conductive, as part of said transmission line structure, which extend through said plate member to be intersected by channels of said first and second pluralities of channels, through which apertures electrical connections, between circuit components mounted on the side of said plate member opposite the side wherein said channels are provided, may pass for a connection to said signal conductors.

12. A transmission line structure according to claim 11, wherein the side walls and commonly-shared floor of said channels are provided with a layer of insulator material thereon.

13. A transmission line structure according to claim 11, wherein said plate member is provided with a plurality of circuit component receiving portions containing circuit components therein, said circuit components having electrical connection portions disposed in alignment with channels of said plate member, and further comprising a plurality of dielectric-surrounded conductors disposed in selected ones of said channels and providing signal path connections to said electrical connection portions of said circuit components.

14. A transmission line structure according to claim 13, further including a layer of conductive material disposed over said channels and being electrically connected to the top land portions of said mesas.

15. A transmission line structure according to claim 14, wherein said layer of conductive material comprises a layer of conductive foil covering said channels and being contiguous with the top land portions of said mesas, and further comprising a layer of flexible material disposed atop said conductive foil layer urging said foil into intimate contact with the top land portions of said mesas so as to be contiguous therewith.

16. A transmission line structure according to claim 13, wherein the height of each of said mesa portions exceeds the outer diameter of said dielectric-surrounded conductors, and wherein said plurality of conductors is arranged in said channels so that, at at least one of the intersections of said first and second pluralities of channels, conductors disposed therein cross over one another, and further comprising a thin portion of conductive material disposed between selected portions of dielectric-surrounded conductors where said conductors overlie one another in a commonly-shared portion of one or more channels.

17. A transmission line structure according to claim 11, wherein said plate member further includes conductive-walled apertures extending therethrough to be intersected by channels of said first and second pluralities of channels, through which apertures electrical connections between circuit components mounted on the side of said plate member opposite the side wherein said channels are provided may pass for connection to said signal conductors.

18. A transmission line structure according to claim 11, wherein said plate member has first and second sides each of which is formed with said first and second pluralities of said regularly-spaced, parallel channels.

19. A structure for supporting and providing signal transmission links among a plurality of spaced apart circuit components comprising a conductive plate member having formed in at least a first surface thereof a first plurality of regularly-spaced, parallel channels extending in a first direction, and a second plurality of regularly-spaced, parallel channels extending in a second direction transverse to said first direction, so as to form, with said first plurality of channels, a waffle-iron-like arrangement of mesa portions each of which extends from a commonly shared floor for each of said channels to a top land portion having a prescribed height above said commonly shared floor, and at least one circuit component receiving portion in which is provided at least one respective circuit component, so that said waffle-iron-like arrangement of mesa portions forms, with signal conductors for connection to said at least one circuit component and disposed in said channels of said first and second pluralities of regularly-spaced parallel channels, a transmission line structure that is periodic in both of said first and second directions and provides a constant transmission line impedance irrespective of a change in channel direction of the disposition of a conductor along channels of either of said first and second pluralities of channels, said at least one circuit component receiving portion being coupled with conductive-walled apertures as part of said transmission line structure which extend through said plate member to be intersected by channels of said first and second pluralities of channels, through which apertures electrical connections, between circuit components mounted on the side of said plate member opposite the side wherein said channels are provided, may pass for connection to said signal conductors.

* * * * *